US007777401B2

(12) United States Patent
Jaffrezic et al.

(10) Patent No.: US 7,777,401 B2
(45) Date of Patent: Aug. 17, 2010

(54) PLASMA SPARK PLUG FOR AN INTERNAL COMBUSTION ENGINE

(75) Inventors: Xavier Jaffrezic, Velizy Villacoublay (FR); Andre Agneray, Boulogne (FR)

(73) Assignee: RENAULT s.a.s., Boulogne Billancourt (FR)

( * ) Notice: Subject to any disclaimer, the term of this patent is extended or adjusted under 35 U.S.C. 154(b) by 149 days.

(21) Appl. No.: 12/064,472

(22) PCT Filed: May 29, 2006

(86) PCT No.: PCT/FR2006/050486

§ 371 (c)(1),
(2), (4) Date: Jul. 22, 2008

(87) PCT Pub. No.: WO2007/023234

PCT Pub. Date: Mar. 1, 2007

(65) Prior Publication Data

US 2009/0114179 A1 May 7, 2009

(30) Foreign Application Priority Data

Aug. 25, 2005 (FR) ..... 05 52562

(51) Int. Cl.
*H01T 13/05* (2006.01)

(52) U.S. Cl. ..... 313/134; 313/137; 123/169 P; 123/143 B

(58) Field of Classification Search ..... 313/134, 313/137; 123/143 B, 169 P, 605, 634, 635
See application file for complete search history.

(56) References Cited

U.S. PATENT DOCUMENTS 5,649,507 A * 7/1997 Gregoire et al. ..... 123/143 B
6,443,137 B1 * 9/2002 Kraft et al. ..... 123/634
6,550,463 B1 * 4/2003 Schmolla ..... 123/606
6,568,362 B2 * 5/2003 Whealton et al. ..... 123/143 B
7,080,638 B2 * 7/2006 Mizutani et al. ..... 123/635
7,243,643 B2 * 7/2007 Iwami et al. ..... 123/635
7,328,677 B2 * 2/2008 Hagiwara et al. ..... 123/143 B
7,652,414 B2 * 1/2010 Jaffrezic et al. ..... 313/143

(Continued)

FOREIGN PATENT DOCUMENTS

FR 2 859 830 3/2005

OTHER PUBLICATIONS

U.S. Appl. No. 12/093,547, filed May 13, 2008, Jaffrezic, et al.

(Continued)

*Primary Examiner*—Erick Solis
(74) *Attorney, Agent, or Firm*—Oblon, Spivak, McClelland, Maier & Neustadt, L.L.P.

(57) ABSTRACT

An essentially-elongated spark plug for an internal combustion engine of a motor vehicle, including: an essentially-capacitive lower part including two coaxial electrodes; an essentially-inductive upper part including a central mandrel, a coaxial winding around the mandrel, and an external tubular casing that serves as electromagnetic armor; and an insulant disposed radially between the casing and the winding. The essentially-inductive upper part includes a second internal casing of electromagnetic armor, which is disposed radially between the insulant and the external casing.

10 Claims, 4 Drawing Sheets

U.S. PATENT DOCUMENTS

| | | | | |
|---|---|---|---|---|
| 2002/0101315 | A1* | 8/2002 | Hamer et al. | 336/90 |
| 2002/0185096 | A1* | 12/2002 | Whealton et al. | 123/143 B |
| 2004/0123851 | A1* | 7/2004 | Schmidt et al. | 123/606 |
| 2006/0048732 | A1* | 3/2006 | Schmidt et al. | 123/143 B |
| 2009/0120394 | A1* | 5/2009 | Heise | 123/143 B |

OTHER PUBLICATIONS

U.S. Appl. No. 11/814,855, filed Jul. 26, 2007, Jaffrezic, et al.
U.S. Appl. No. 11/993,930, filed Dec. 26, 2007, Jaffrezic, et al.
U.S. Appl. No. 12/090,722, filed Apr. 18, 2008, Agneray, et al.

* cited by examiner

PLASMA SPARK PLUG FOR AN INTERNAL COMBUSTION ENGINE

The invention relates to a plasma generation plug used particularly for the ignition of internal combustion engines by electric sparks between the electrodes of a plug.

More precisely, it relates to an internal combustion engine spark plug comprising two plasma generation electrodes separated by an insulator which respectively form an external shell surrounding the insulator, and a central electrode housed in a central bore of the insulator.

Through publications FR2859830, FR2859569, FR2859831, a multispark plug has an electromagnetic shield materialized by a metal casing that can be produced, for example in the form of a thin fashioned tube or of a thin deposited layer or of a metallized and plated plastic film.

The electromagnetic shield comprises two portions: the electric shield and the magnetic shield. The electric shield makes it possible to protect the environment of the plug from the interference caused by the electric field created by the winding. The magnetic shield makes it possible to ensure that the magnetic field remains inside this casing. The travel of the current corresponding to the electric shield effects is limited to the external face of the casing while the travel of the current linked to the magnetic shield is limited to the internal face of the casing. In addition, to provide insulation between the mandrel and the casing, the insulator is usually made of materials having particular physical-chemical characteristics with, as a counterpart, coefficients of expansion according to the temperature of the material that may be considerable.

It is therefore difficult to reconcile both the electromagnetic shield and the insulation between the mandrel and the casing.

In order to alleviate these disadvantages, the object of the invention is to produce an electromagnetic shield while providing insulation between the mandrel and the casing.

Accordingly, the invention proposes a plug of the above-mentioned type, characterized in that the top essentially inductive portion comprises a second inner electromagnetic shield casing that is interposed radially between the insulator and the outer casing.

According to other features of the invention, the internal face of the inner casing is adjacent to the external face of the insulator.

According to other features of the invention, the inner casing is of constant thickness.

According to other features of the invention, the outer casing has a thickness at least equal to the skin thickness that corresponds to the depth of penetration of the current lines in the outer casing.

According to other features of the invention, the internal face of the outer casing is of cylindrical shape with circular section, the external face of the inner casing is of cylindrical shape with polygonal section and the inner casing is designed so that the axial ridges of the inner casing are in electrical contact with the internal face of the outer casing.

According to other features of the invention, the mandrel is of cylindrical shape.

According to other features of the invention, the outer casing is chosen from electrically conductive materials such as copper.

According to other features of the invention, the inner casing is chosen from electrically conductive materials such as copper.

According to other features of the invention, the material of the outer casing and the dimensions of the outer casing are chosen so that the outer casing forms a shield at least for the electric field generated by the winding.

According to other features of the invention, the material of the inner casing and the dimensions of the inner casing are chosen so that the inner casing forms an electromagnetic shield.

Other features and advantages of the invention will appear on reading the description of exemplary embodiments with reference to the appended figures.

Identical or similar elements are indicated by the same reference numbers.

Figure 1:
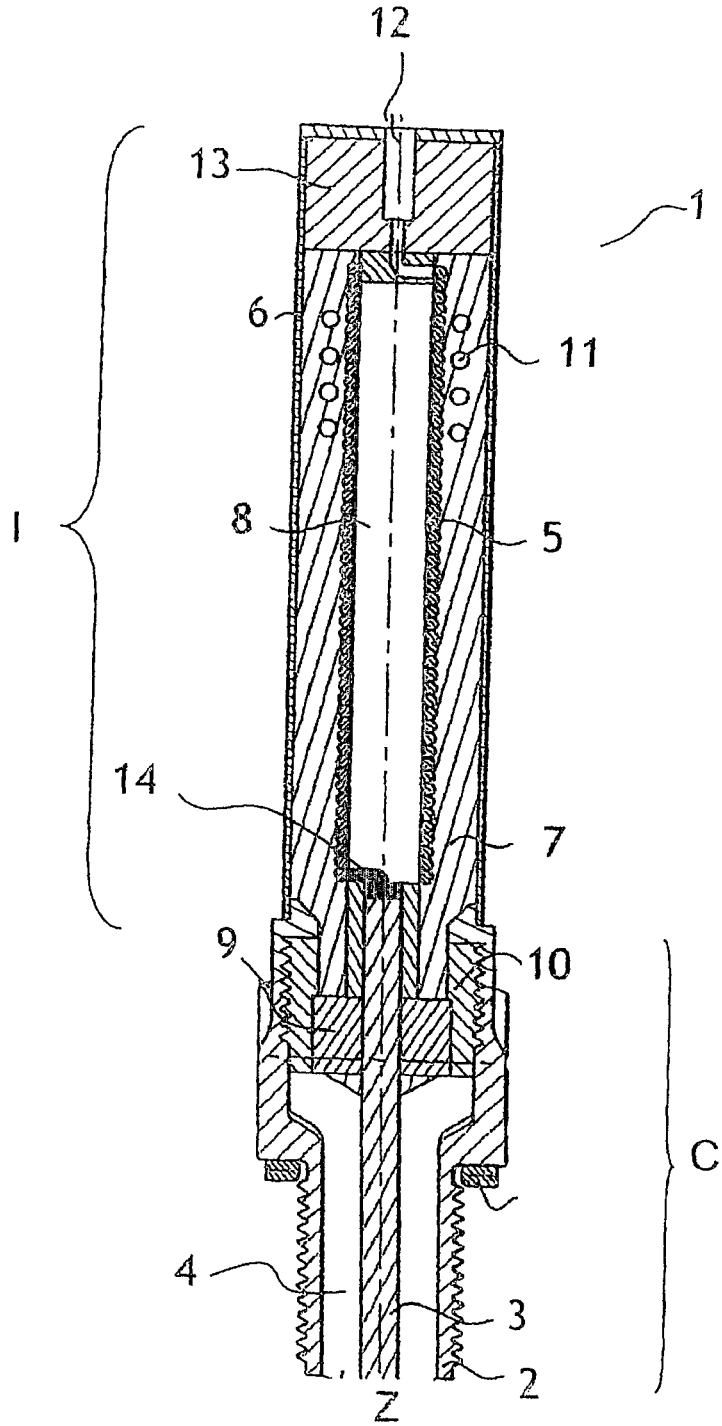
Figure 1 PRIOR ART
FIG. 1 represents a schematic view in section along the axis Z of a radiofrequency plasma plug according to the prior art.

As shown in FIG. 1, a radiofrequency plasma plug 1 of generally substantially cylindrical shape comprises mainly a bottom essentially capacitive portion C and a top essentially inductive portion I, the portions C and I being of substantially elongated shape, connected in series and comprising a common longitudinal axis Z.

The essentially capacitive portion C comprises, in particular, a shell 2 designed to be connected to earth and surrounding a central electrode 3, that is substantially cylindrical and has an axis Z, playing the role of the high voltage electrode. An electrically insulating block, called the "insulator" 4 is placed between the shell 2 and the central electrode 3, the insulator 4 being configured so as to guide the sparks between the electrodes 2 and 3. In a manner well known in the prior art, the shell 2 has, on the external face of its bottom portion closest to the cylinder head of the internal combustion engine fitted with the plug 1, a shape appropriate to the installation, retention and tightening of the plug 1 on the cylinder head (for example and in a nonlimiting manner, as shown in FIG. 1: a thread).

Figure 2:
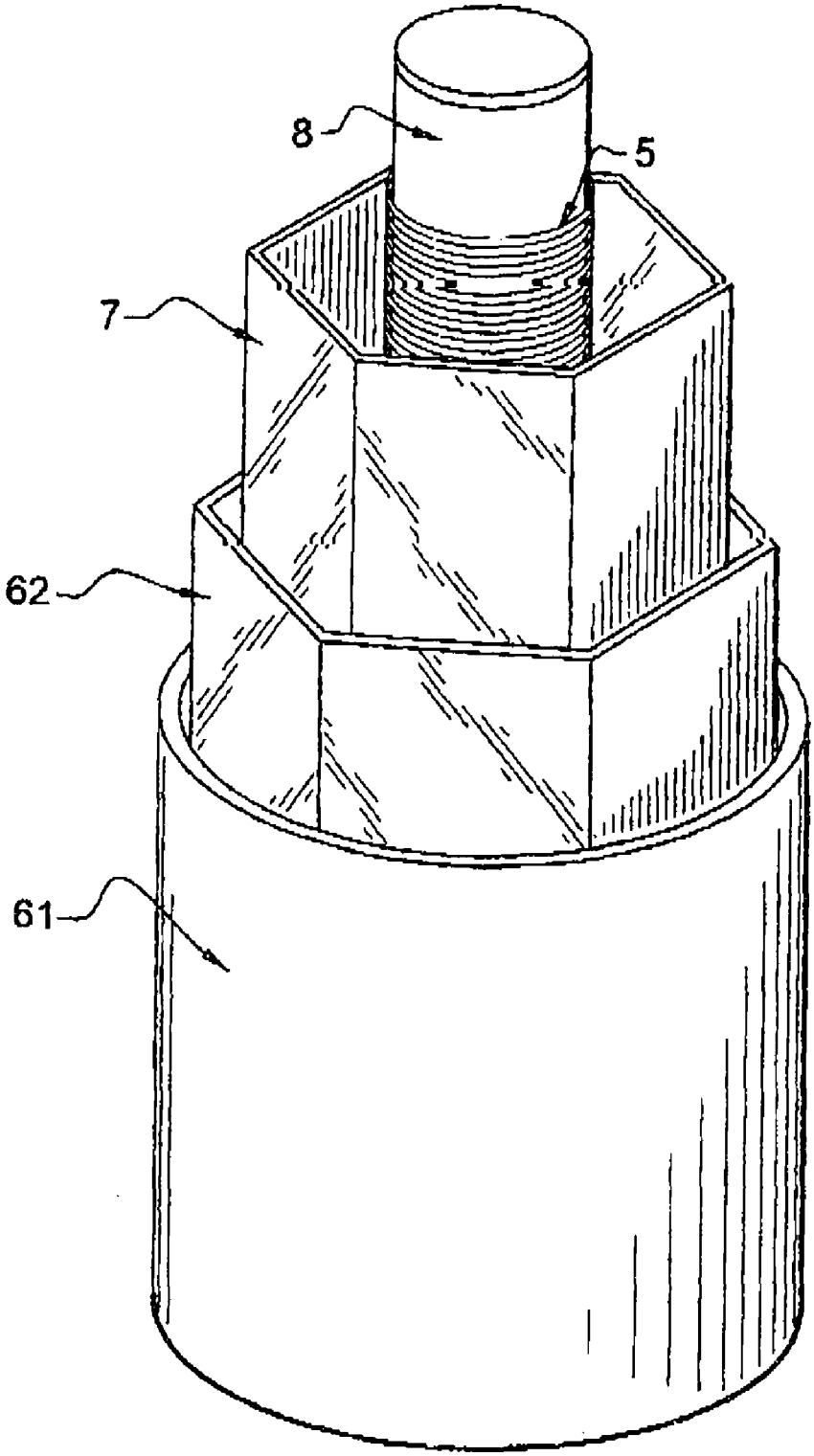
FIG. 2 represents a schematic "exploded" view of the inductive portion of a plug comprising two casings according to the invention.
Figure 3:
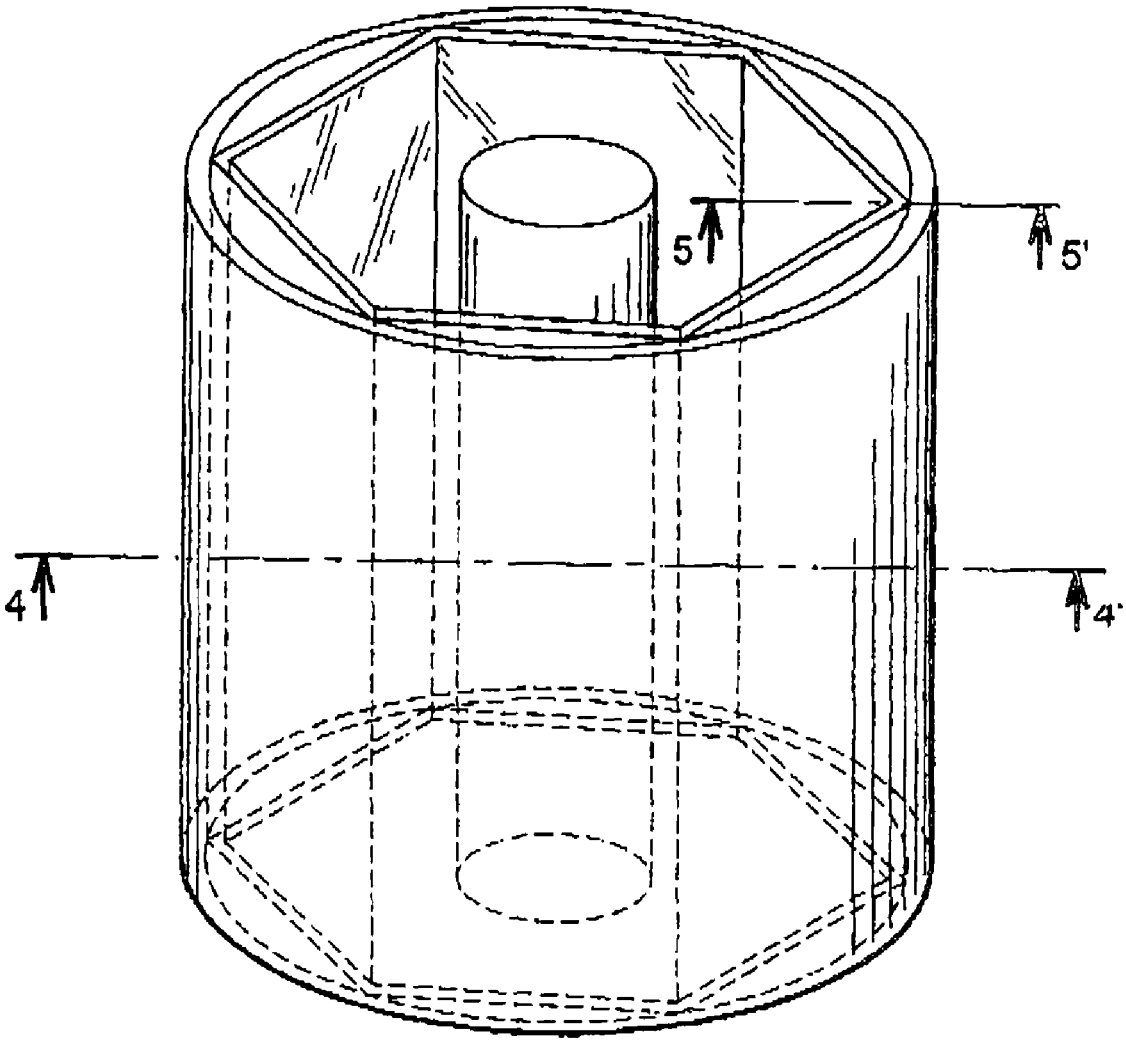
FIG. 3 represents a schematic view in section of the inductive portion of a plug comprising two casings according to the invention.

As represented in FIG. 2 and FIG. 3, the essentially inductive portion I of the plug 1 comprises a central mandrel 8 surrounded successively by a winding 5, an insulator 7, an inner casing 62 and an outer casing 61.

The mandrel 8 is of cylindrical shape with circular section whose axis is substantially indistinguishable from the axis Z of the plug 1. It is made of an insulating and nonmagnetic material.

The winding 5 consists of turns 51 surrounding the central mandrel 8 from a first top turn 512 to a last bottom turn 513. As shown in FIG. 1, the first top turn 512 is connected to the connector 12 and the last bottom turn 513 is connected by appropriate means 14 to an inner end of the central electrode 3.

The insulator 7 that surrounds the winding 5 is of cylindrical shape with polygonal section and it is chosen to be of a material with low magnetic losses. Amongst the materials satisfying this property, there is the silicones family whose major disadvantage is that it has a considerable coefficient of thermal expansion of the order of 0.0001 $K^{-1}$.

Figure 4:
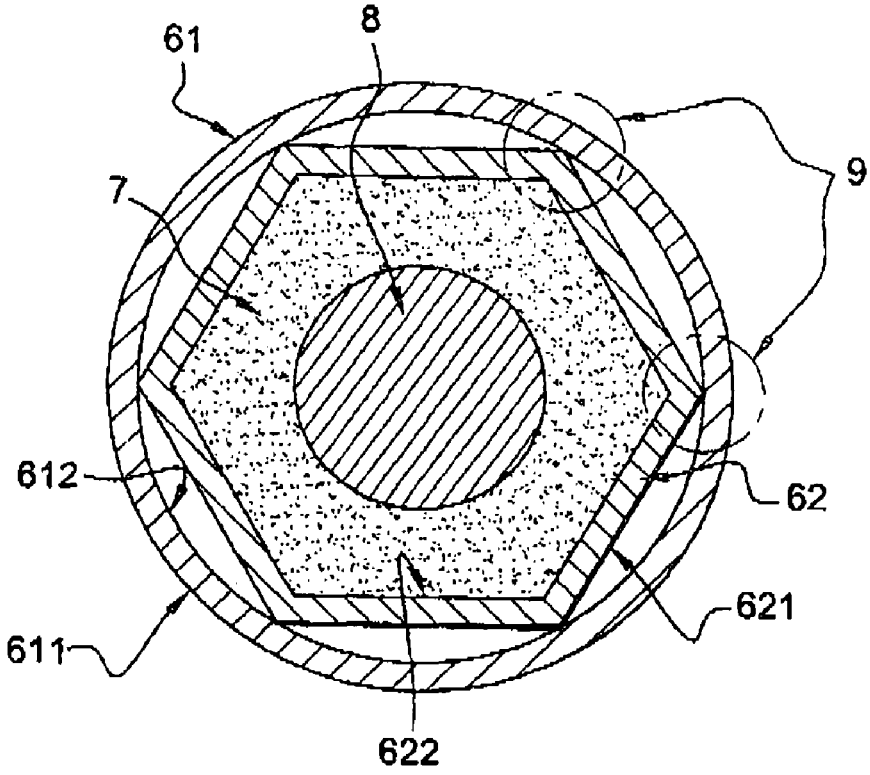
FIG. 4 represents a schematic view in section along the axis 4-4' of FIG. 3 according to the invention.

As shown in FIG. 4, the inner casing 62 comprises an internal face 622 and an external face 621. It is of cylindrical shape with polygonal section. Nevertheless, only the external face 621 may be chosen to be of cylindrical shape with polygonal section. The inner casing 62 is made so that the internal face 622 of the inner casing 62 is adjacent to the external face 71 of the insulator 7. The inner casing 62 is chosen to be of a conductive material in the frequency domain, situated between 1 MHz and 10 MHz, claimed for the operation of this plug 1. It may be made of different metal materials, for example of copper or of various materials covered on their outer faces with metal salts, for example a deposit of electro-plated nickel. The thickness of this casing 61 is chosen to be constant and sufficiently thin to ensure a low frequency conductivity. For example the inner casing 62 may be chosen to be made of copper of 5 to 10 μm.

As shown in FIG. 4, the outer casing 61 comprises an external face 611 and an internal face 612. It is of cylindrical shape with circular section. But, only its internal face 612 may be chosen to be of cylindrical shape with circular section. This casing 61 is chosen to be made of a material and is designed so that the travel of the currents associated with the electromagnetic shield is ensured. This outer casing 61 is chosen to be made of a conductive material in the frequency domain, situated between 1 MHz and 10 MHz, claimed for the operation of this plug 1. It may be made of a high conductivity material (such as copper: $6\times10^7$ S/m) or of a low conductivity material (such as steel: $1\times10^7$ S/m) and covered on its external faces by a conductive layer, for example copper or silver. The thickness of this casing 61 is at least greater than the skin thickness that corresponds to the depth of penetration of the current lines in a conductor in the frequency domain, situated between 1 MHz and 10 MHz, claimed for the operation of this plug 1. For example, if the outer casing 61 is made of copper, its thickness is at least 100 μm. The inner casing 61 is designed so that its axial ridges 613 are in electrical contact with the internal face 612 of the outer casing 61. Surface roughness defects of the external face 611 of the outer casing 61 are no barrier to the electrical contact of the two casings 61, 62. Specifically, along a ridge 613, the electrical contact may be provided in places at a few points 9 of the ridge 613.

In addition, the empty zones created between the inner casing 62 and the outer casing 61 allow the insulator 7, having a high coefficient of thermal expansion, to expand while converging on a substantially cylindrical external shape partially or totally filling the empty zones.

The electromagnetic shield is provided in such an embodiment.

Figure 5:
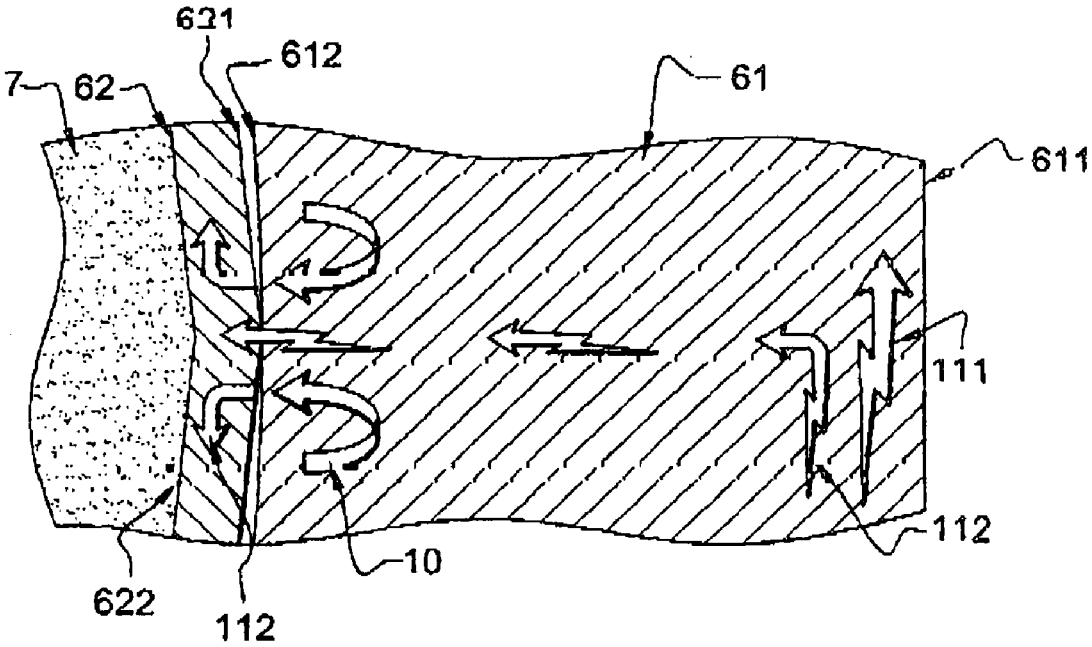
FIG. 5 represents the travel of the currents associated with the electromagnetic field via a view in section along the axis 5-5' of FIG. 3 according to the invention.

Specifically, as shown in FIG. 5, the current 10 associated with the magnetic shield travels principally on the internal face 612 of the outer casing 61. The current associated with the electric shield travels mainly on the external face 611 of the outer casing 61. It comprises in particular two components: a first component 111 that corresponds to the electric charging of the capacitor situated at the end of the winding 5 and a second component 112 that corresponds to the current necessary to block the electric field created by the winding 5. First, this second component 112 travels radially on the outer casing 61 and on points of contact 9 of the interface between the inner casing 62 and the outer casing 61. Secondly, it travels in the inner casing 62 so as to spread evenly to shield the electric field created by the winding 5.

Furthermore, the torque for achieving the connection between the essentially capacitive portion C and the essentially inductive portion I of the plug 1 is transmitted via the outer casing 61. The thickness of the outer casing 61 will therefore be designed so as to transmit this tightening torque. The main advantage of this type of transmission is that it carries the mechanical stresses over the largest possible radius, at the location where the lever arm effect is optimal, thereby minimizing the mechanical stresses on the materials themselves.

Therefore, the casings 61, 62 effectively provide an electromagnetic shield while fulfilling the function of the insulator 7 that is a material with a high coefficient of expansion.

This invention is not limited to the embodiment described and illustrated that has been given as an example.

The invention claimed is:

1. A spark plug, for an internal combustion engine of a motor vehicle, of generally substantially elongated shape, comprising:

a bottom essentially capacitive portion comprising two coaxial electrodes;

a top essentially inductive portion comprising:

a central mandrel, a coaxial winding around the mandrel, an outer tubular casing performing an electromagnetic shield function, an insulator interposed radially between the casing and the winding, wherein the top essentially inductive portion comprises a second inner electromagnetic shield casing that is interposed radially between the insulator and the outer casing.

2. The spark plug as claimed in claim 1, wherein the internal face of the inner casing is adjacent to the external face of the insulator.

3. The spark plug as claimed in one claim 1, wherein the inner casing is of constant thickness.

4. The spark plug as claimed in claim 1, wherein the outer casing has a thickness at least equal to a skin thickness that corresponds to a depth of penetration of current lines in the outer casing.

5. The spark plug as claimed in claim 1, wherein the internal face of the outer casing is of cylindrical shape with circular section, the external face of the inner casing is of cylindrical shape with polygonal section, and the inner casing is configured so that axial ridges of the inner casing are in electrical contact with an internal face of the outer casing.

6. The spark plug as claimed in claim 1, wherein the mandrel is of generally cylindrical shape.

7. The spark plug as claimed in claim 1, wherein the outer casing is an electrically conductive material or copper.

8. The spark plug as claimed in claim 1, wherein the inner casing is of an electrically conductive material or copper.

9. The spark plug as claimed in claim 1, wherein the outer casing forms a shield at least to an electric field generated by the winding.

10. The spark plug as claimed in claim 1, wherein the inner casing forms an electromagnetic shield.

* * * * *